US006561414B1

(12) United States Patent
Cai

(10) Patent No.: US 6,561,414 B1
(45) Date of Patent: May 13, 2003

(54) FOOD SCOOP WITH SEALED BASE

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 10/067,942

(22) Filed: Feb. 8, 2002

(51) Int. Cl.[7] ..... B65D 3/28

(52) U.S. Cl. ..... 229/400; 229/4.5; 229/104; 294/55

(58) Field of Search ..... 294/1.3, 1.4, 1.5, 294/55; 229/4.5, 104, 193, 400, 405

(56) References Cited

U.S. PATENT DOCUMENTS 4,267,955 A * 5/1981 Struble ..... 294/55
4,502,623 A * 3/1985 Moore et al. ..... 229/400
4,711,389 A * 12/1987 Alba et al. ..... 229/400
4,915,235 A * 4/1990 Roosa ..... 229/400
5,564,762 A * 10/1996 Ring ..... 294/55
5,729,429 A * 3/1998 Margaritis et al. ..... 361/680
6,053,403 A * 4/2000 Cai ..... 229/400
2002/0084319 A1 * 7/2002 Yocum ..... 229/400

* cited by examiner

*Primary Examiner*—Dean J. Kramer
*Assistant Examiner*—Paul T. Chin
(74) *Attorney, Agent, or Firm*—Dennison, Schultz & Dougherty

(57) ABSTRACT

A food scoop of a generally upwardly tapering truncated configuration having a lower portion of rectangular cross section and an upper portion of circular cross section with a bottom in edge contact with the peripheral wall of the scoop completely thereabout and with opposed combined glue and sealing flaps integral with the bottom and bonded to opposed sides of the scoop wall and with the surface of the bottom devoid of fold lines, score lines or perforations.

20 Claims, 4 Drawing Sheets

FOOD SCOOP WITH SEALED BASE

BACKGROUND OF THE INVENTION

Food scoops of the type normally referred to as fry scoops are widely used in coffee shops, quick service restaurants, convenience stores and other such "fast food" establishments, for the dispensing of chips, fries, popcorn, chicken nuggets and like "finger" foods.

Such known scoops are of a generally narrow rectangular configuration with a higher back wall providing for or assisting in the scooping of the fries therein.

With the conventional generally rectangular scoop, the container, when filled, will normally lie flat on its back panel with the contents tending to spill from the open mouth thereof. Alternately, the scoop may be held upright in the consumer's hand or is otherwise physically maintained in a vertical position as by being wedged in a serving tray by adjacent products. The actual holding of the scoop can be awkward because of the elongate rectangular configuration.

The conventional scoop also incorporates multiple vertical fold lines extending for the full height thereof and defining distinct narrow planar sides to the scoop which do not particularly lend themselves to a continuous surface pattern about the peripheral wall of the scoop. Problems may also arise with regard to the proper filling of the conventional scoop, and the withdrawal of foods therefrom in light of the relatively narrow elongate nature of the scoop and the angular corners provided about the interior thereof.

One improved form of scoop will be noted in Applicant's U.S. Pat. No. 6,053,403, assigned to the assignee of the present invention. This scoop is of a preformed, inverted, truncated conical configuration with the rounded lower portion of the scoop adapted for engagement within a cup holder.

It has also been suggested to form the lower portion of such containers into a cross-sectional configuration which more closely approaches a square rather than an elongate rectangle with fold lines defining the lower generally square configuration of the scoop and with the opposed sides of the scoop being substantially planar for at least a portion of the height thereof upward from the bottom. Such containers have been proposed as providing for greater stability for a self-standing scoop. However, there is much room for improvement. In this regard, a square bottom has not heretofore particularly lent itself to formation from a single blank without relying on a rather complex arrangement of fold and score lines and a corresponding use of extra material beyond that actually required to form the food chamber. This in turn also leads to an increase in the time and complexity of the actual manufacturing process. Further, problems in attempting to provide a wrinkle-free base have also been encountered.

Another significant problem noted with regard to known scoops formed from a single blank of folded paperboard or like material is the difficulty in avoiding gaps in the lower portions thereof, particularly between the bottom and side walls thereof.

SUMMARY OF THE INVENTION

The present invention proposes significant advances in the art with regard to many aspects of the conventional fry scoop and known variations thereof.

Initially, the scoop of the invention is capable of being formed utilizing conventional equipment with the formed configuration of the scoop specifically allowing for nesting of the scoops so as to minimize packing space, resulting in both shipping and storage economies. The formed configuration of the scoop provides a base which is not only readily accommodated within a conventional cup holder, whether in a carrying tray or a vehicle mounted cup holder, but is also particularly formed to provide a stable base for a self-standing scoop.

A significant object of the invention is the incorporation in the scoop of a sealed bottom, eliminating the gaps normally associated with folded paperboard cartons of this type. Thus, the scoop of the invention is particularly capable of accommodating various condiments and flavorings as might be applied to the finger foods supplied within the scoop, for example melt butter on popcorn, salt and pepper on fries of various types, and the like, all without leakage.

Also of particular significance is the formation of the scoop using a unitary blank which provides for an improved production layout with very limited scrap area, utilizing minimal board to obtain maximum volume. The actual nature of the blank from which the carton is formed, and the configuration of the formed carton combine to allow a manufacturing system utilizing traditional equipment with the blank, with minimal fold lines, allowing for increased forming speed of the equipment, simplified and more easily performed folding steps, and blank elements which cooperate during the folding procedure, aligning on and relative to each other in achieving the desired bottom-sealed configuration.

Basically, the scoop of the invention is of an inverted slightly truncated configuration with an open upwardly directed mouth and a closed and sealed bottom. The lower portion of the scoop, upward from the bottom, is of a generally square or rectangular cross-sectional configuration which gradually expands upward into an upper portion of substantially circular configuration. The bottom panel of the scoop has no disruptive fold lines and is preferable substantially square with the continuous lower edge of the scoop wall intimately engaged with the bottom panel along the four edges with no gapping therebetween. A first pair of opposed edges of the bottom panel are integrally formed with the wall lower edge, with the second pair of bottom panel edges having integral laterally outwardly extending combined sealing and glue flaps upwardly folded therefrom to overlie opposed flattened lower outer portions of the vertical wall to seal the second pair of opposed bottom edges to the overlying wall portions along the full length of contact therebetween.

As a variation, the first pair of opposed edges of the bottom panel, those edges integral with opposed portions of the lower edge of the vertical wall, can be concave, forming a slight outward bowing of the corresponding portions of the vertical wall thereabove and providing a corresponding increase in the volume of the container or scoop. This increase in volume requires no additional blank material and retains the desired generally rectangular configuration of the lower portion of the scoop without any necessity for providing fold lines within the bottom panel. The bottom panel, formed in this manner, will actually upwardly arc along the length thereof between the arcuate edges while the second linear pair of edges remain in a common plane and define spaced support edges for the scoop. Such spaced support edges provide enhanced stability for the scoop when used as a self-standing scoop in that any slight irregularities in the supporting surface, tabletop or the like, can be more readily accommodated as compared to a completely planar base in the first described embodiment. It has also been found that the slight arcuate configuration of the bottom tends to provide an additional degree of rigidity.

The blank of the invention, utilized in the formation of the above-described scoops, comprises opposed front and rear wall panels aligned along a longitudinal axis of the blank with the panels having spaced facing lower or base edges with a rectangular bottom panel extending between the lower edges. Each lower edge of the front and rear wall panels includes a central extent and opposed edge extents. The bottom or bottom panel of the first mentioned embodiment includes a first pair of parallel longitudinally spaced end edges coextensive with the central extents of the front and rear wall panels and are integral therewith. This bottom panel further includes a second pair of side edges extending between the corresponding ends of the first pair of bottom panel edges to define a rectangular and preferably square configuration to the bottom panel. A laterally directed, triangular, combined glue and sealing flap is integral with the bottom panel along each of these second pair of side edges. The triangular flap includes a base edge coextensive with the corresponding side edge of the bottom panel and integral therewith along the full length thereof with a fold line defined therealong. The side flaps are each basically in the shape of an isosceles triangle with the outwardly converging sides thereof terminating in an apex generally aligned with the outer extremities of the lower edges of the front and rear wall panels centrally therebetween.

In order to facilitate forming of the desired substantially rectangular lower portion of the scoop, each of the front and rear panels is provided with a pair of laterally spaced fold lines extending partially therealong upward or inward from the lower edge thereof generally aligned with the fold lines defined between the bottom panel and opposed glue flaps integral therewith. The above-described fold lines constitute the only fold lines in the blank.

The blank utilized in forming the second embodiment of the scoop with the arced bottom panel differs from the first described blank only in that the first pair of bottom panel end edges are slightly arced, as is the central extent of the lower edges of the front and rear panels.

It is significant to note that the side extents of each of the lower edges of the front and rear wall panels are straight or linear and angled, relative to the central extent, slightly downward and outward relative to the corresponding edge to engage along the full length thereof with the opposed side edges of the bottom panel immediately inward of the side glue flaps in the erected scoop.

Other feature and details of the scoop and blank comprising the invention will become apparent from the following more specific description of the invention.

DESCRIPTION OF PREFERRED EMBODIMENTS

Figure 1:
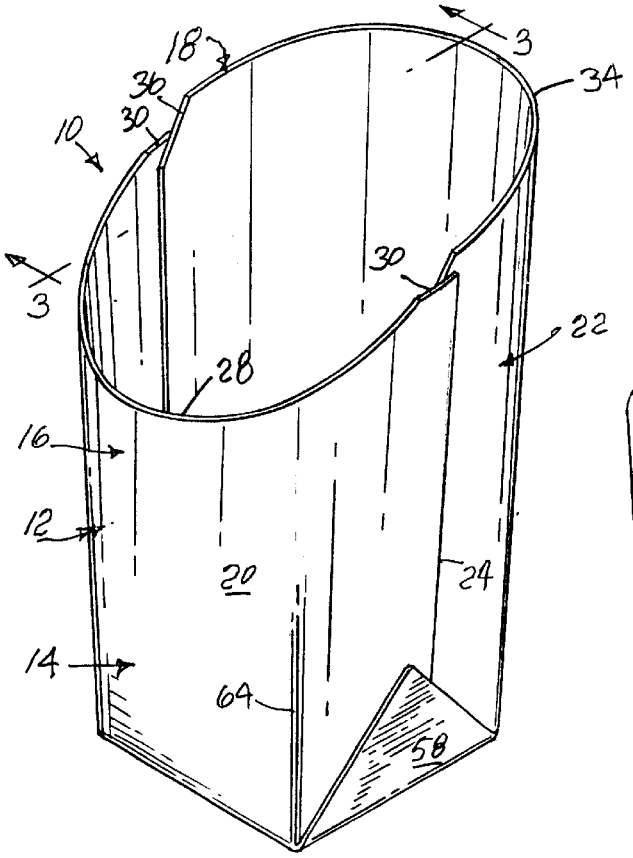
FIG. 1 is a top perspective view of the scoop of the invention.
Figure 2:
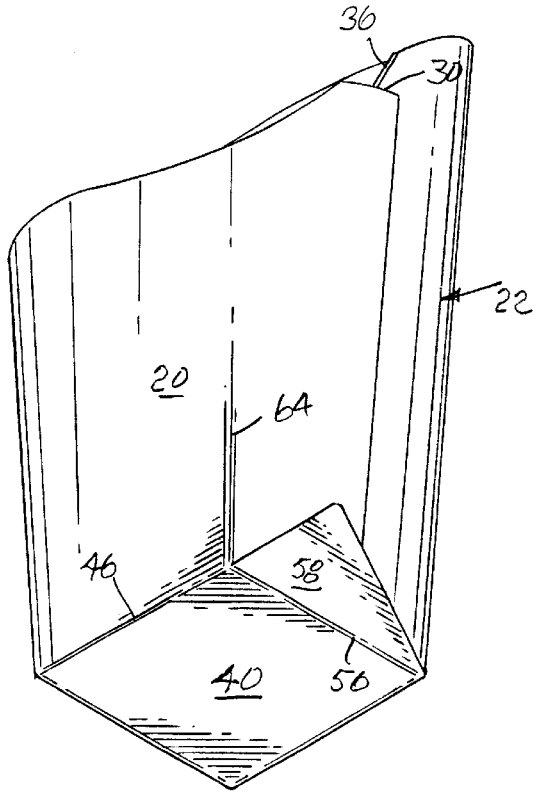
FIG. 2 is a bottom perspective view thereof.

The scoop or fry carton 10 includes a vertical peripheral wall 12 of a generally conical configuration increasing upwardly from a lower portion 14 of substantially rectangular, and preferably square, cross section to an upper portion 16 of a substantially round cross section which extends to an enlarged curvilinear and generally inclined peripheral upper edge 18.

Figure 4:
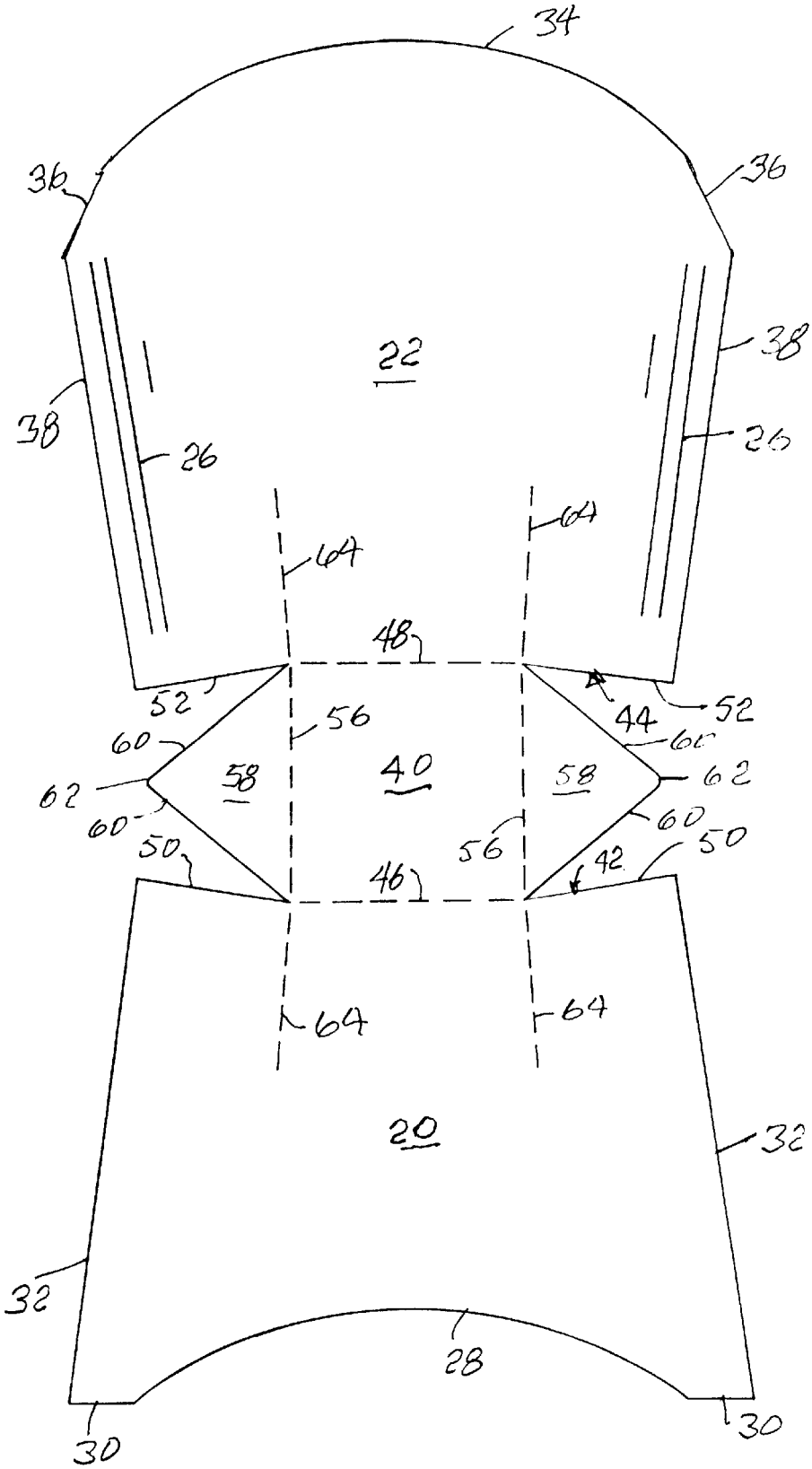
FIG. 4 is a plan view of the blank from which the scoop of FIG. 1 is folded.

The wall 12, also noting the blank of FIG. 4, is defined by front and rear wall panels 20 and 22 inwardly rolled toward each other into semi-cylinders with overlapping edge portions adhesively bonded to form opposed side seams 24. In order to enhance the adhesive bonding at the side seams 24, particularly in those instances wherein the faces of the wall panels may be coated with a moisture barrier at the point of overlap, the lap forming edge portions of the rear wall panel far 22 may, as indicated in the blank, have linear scratch lines 26 therein which cut through the moisture barrier without disruption of the corresponding opposed surface of the wall panel.

The specific curvilinear nature of the upper or outer edge 18 of the scoop 10, that is the concave forward edge portion and the higher convex rear edge portion, are achieved by configuring these edge portions as noted in the blank of FIG. 4. More specifically, the upper or outer edge of the front wall panel 20 is concave along a major extent 28 thereof, terminating in short laterally directed extents or lengths 30 at the opposed ends which extend to the outwardly diverging opposed side edges 32 of this front wall panel.

The outer or upper edge of the rear wall panel 22 includes a convex central length or extent 34 complementary in shape and in configuration to the concave extent 28 of the front wall panel. The convex length 34 terminates in a pair of beveled end portions 36 which extend to the opposed upwardly diverging side edges 38 of the rear wall panel 22. As will be appreciated, these beveled edge extents 36, along with the truncated edge extents 30 of the outer edge of the front panel 22, avoid sharp corners such as might interfere with the high speed folding of the wall panels during the manufacturing procedure. While thus causing a slight break in the upper edge 18 of the scoop 10, this avoids any incidental upward projection of a disruptive edge, and in no way affects the strength, volume, or any other feature of the scoop.

Of particular significance is the lower portion 14 of the scoop 10, the rectangular or square cross section thereof and the planar imperforate bottom panel 40. It is intended that the bottom panel 40 provide a flat surface, the formation of which does not require the use of arrangements of fold lines, lines of perforations, and the like, heretofore considered necessary in order to form a base for scoops of the type with which the present invention is concerned, whether formed as folded cartons for subsequent erection, or preformed into the scoop configuration.

With reference to the blank of FIG. 4, and the linear alignment of the front and rear wall panels 20 and 22, it will be noted that the facing base edges 42 and 44 of the front and rear wall panels 20 and 22 respectively, include linear or straight spaced parallel central extents 46 and 48 with the bottom wall panel 40 being integral with the front and rear wall panels along bottom wall end edges coextensive with the linear edge extents 46 and 48. A linear fold line is defined along each of the central linear extents 46 and 48, also illustrated in the blank by these reference numerals, thus allowing for an upward folding of the front and rear wall panels as shall be referred to subsequently.

Each of the base wall edges 42 and 44 of the front and rear wall panels, outward of the central edge lengths 46 and 48, includes a pair of straight or linear end extents 50,52, extending laterally outward from the opposed ends of the corresponding central extent 46 or 48 and at a slight angle thereto, whereby the corresponding extents 50 and 52 at each side of the bottom panel 40 converge slightly outward from the corresponding side of the bottom panel. As will be noted in the blank, these edge extents 50,52 are each of a length slightly greater than one-half of the length of the corresponding central edge extent 46 or 48, and meet the corresponding side edges 32 or 38 of the front and rear wall panels 20 amnd 22 at approximately a 90° angle.

The bottom panel 40 further includes a pair of laterally spaced parallel straight or linear side edges 56. A side glue and sealing panel 58, of triangular configuration, is integral with and coextensive with the bottom panel 40 along each of the side edges 56 with a single fold line, indicated by the side edge reference numeral 56, along the full length thereof. The side edges 60 of each sealing panel 58, which is basically in the configuration of an isosceles triangle, converge laterally outward to an apex 62 approximately aligned with the outer ends of the front and rear wall panel edges 42 and 44. The blank is completed by the provision of four score or fold lines 64, one line 64 extending upwardly or outwardly into each of the front and rear wall panels 20 and 22 from each opposed end of the central extents 46 and 48 of the lower edges 42 and 44 of the front and rear panels. The fold lines 64 are in general alignment with the side edges 56 of the bottom panel 40 and extend from the corner defined at the juncture of the base edge end extents 50,52 and the corresponding base edge central extents 46 and 48. It will be noted that the inclined inwardly diverging edges 60 of the sealing panels 58 also terminate at this point. The fold lines 64 extend for a minor height of the front and rear wall panels and of the scoop formed therefrom. Such fold lines, in conjunction with the rectangular or square bottom panel 40, function to maintain the desired rectangular configuration of the lower portion 14 of the scoop for a predetermined height sufficient to allow for reception within a conventional automobile cup holder, or the like.

Figure 3:
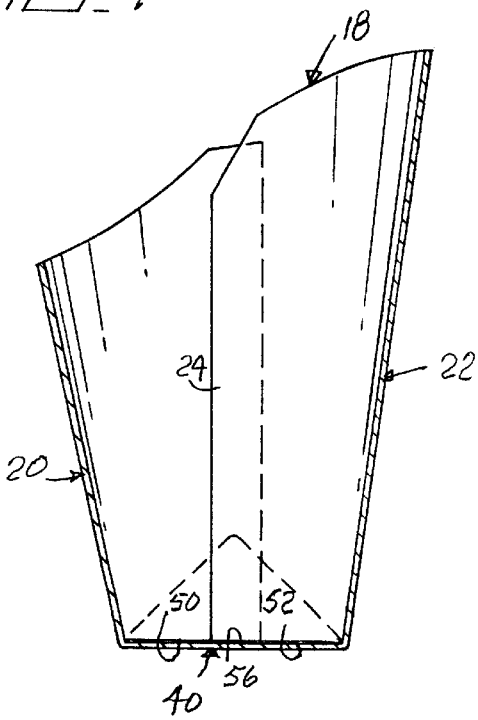
FIG. 3 is a vertical cross-sectional view through the scoop taken substantially on a plane passing along line 3—3 in FIG. 1.

In folding the blank into the scoop configuration, the front and rear wall panels 20 and 22 are upwardly folded along the end edges 46 and 48 of the bottom panel 40. The front and rear walls are inwardly curved to the desired semi-cylindrical configuration with the fold lines 64 allowing for a flattening of the lower portions thereof to achieve the desired rectangular configuration. Noting FIG. 3 in particular, the base edge extents 50,52 of each of the front and rear wall panels engage, for the full length thereof, directly on the bottom panel 40 along the opposed side edges 56 of the bottom panel 40, overlapping each other, and extending for the full length of the side edges 56 so as to, in effect, seal thereagainst. The linear nature of these base edge end extents, ensures full length contact with the bottom 40 along the opposed side edges 56 thereof. The right angular relationship of these end extents to the opposed diverging side edges of the front and rear panels also provides for the desired vertical orientation of these front and rear panel side edges in the defined opposed seams 24 of the scoop 10 in conjunction with the upward and outward inclination of the formed front and rear wall panels in the formed scoop.

The formation of the scoop is completed by an upward folding of the combined glue and sealing side panels or flaps 58 to overlie the side walls of the scoop at the seam formed sides thereof so as to both seal the corresponding opposed parallel bottom edges of the carton, and retain the base edge end extents 50 of the front and rear panels fully engaged on the bottom panel 40 along the full length of the opposed side edges 56 thereof.

A further embodiment of the invention is illustrated in FIGS. 5–8 and wherein like components and features have been indicated by like reference numerals. Basically, the only difference in the formation of the blank of FIG. 8 resides in the formation of the opposed end edges 80 and 82 of the bottom panel 78 as arcuate, that is concave relative to the corresponding base edges 42 and 44 of the front and rear wall panels 20 and 22. The bottom panel 78 is integral with the corresponding wall panels 20 and 22 along these concave extents 80 and 82 and, an arcuate fold line is coextensive with each of these bottom panel end edges 80 and 82. The bottom panel 78, of the blank of FIG. 8, similar to the bottom panel 40 of the blank of FIG. 4, is devoid of any surface interrupting fold lines, score lines, and the like.

Figure 5:
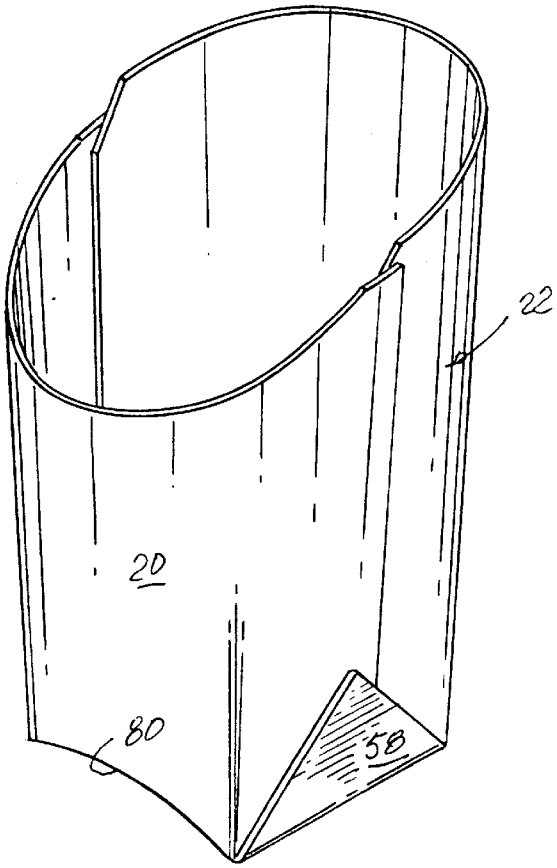
FIG. 5 is a top perspective view of a modified form of the scoop.
Figure 6:
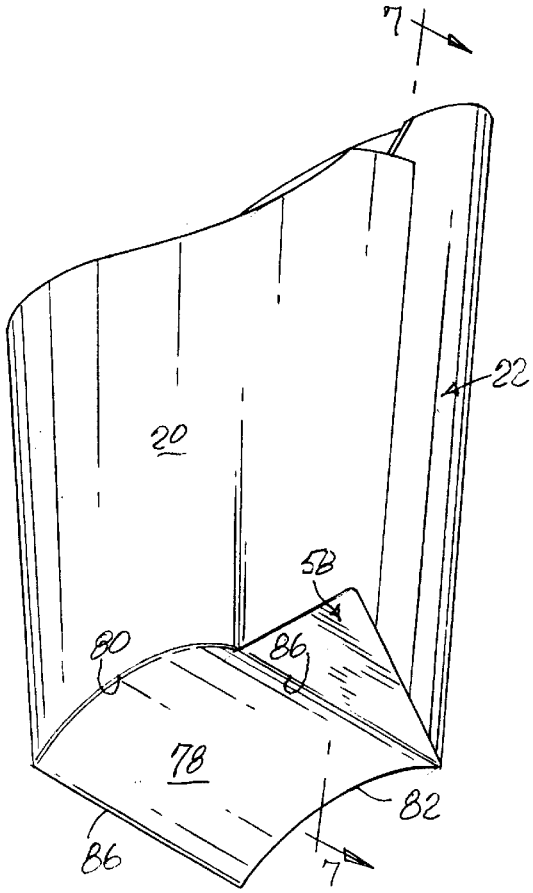
FIG. 6 is a bottom perspective view of the modified form of scoop of FIG. 5.
Figure 7:
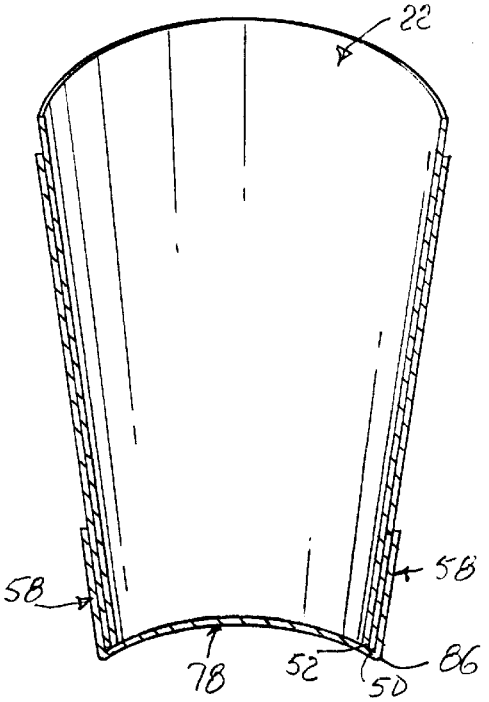
FIG. 7 is a vertical cross-section view of the modified scoop taken substantially on a plane passing along line 7—7 in FIG. 6.
Figure 8:
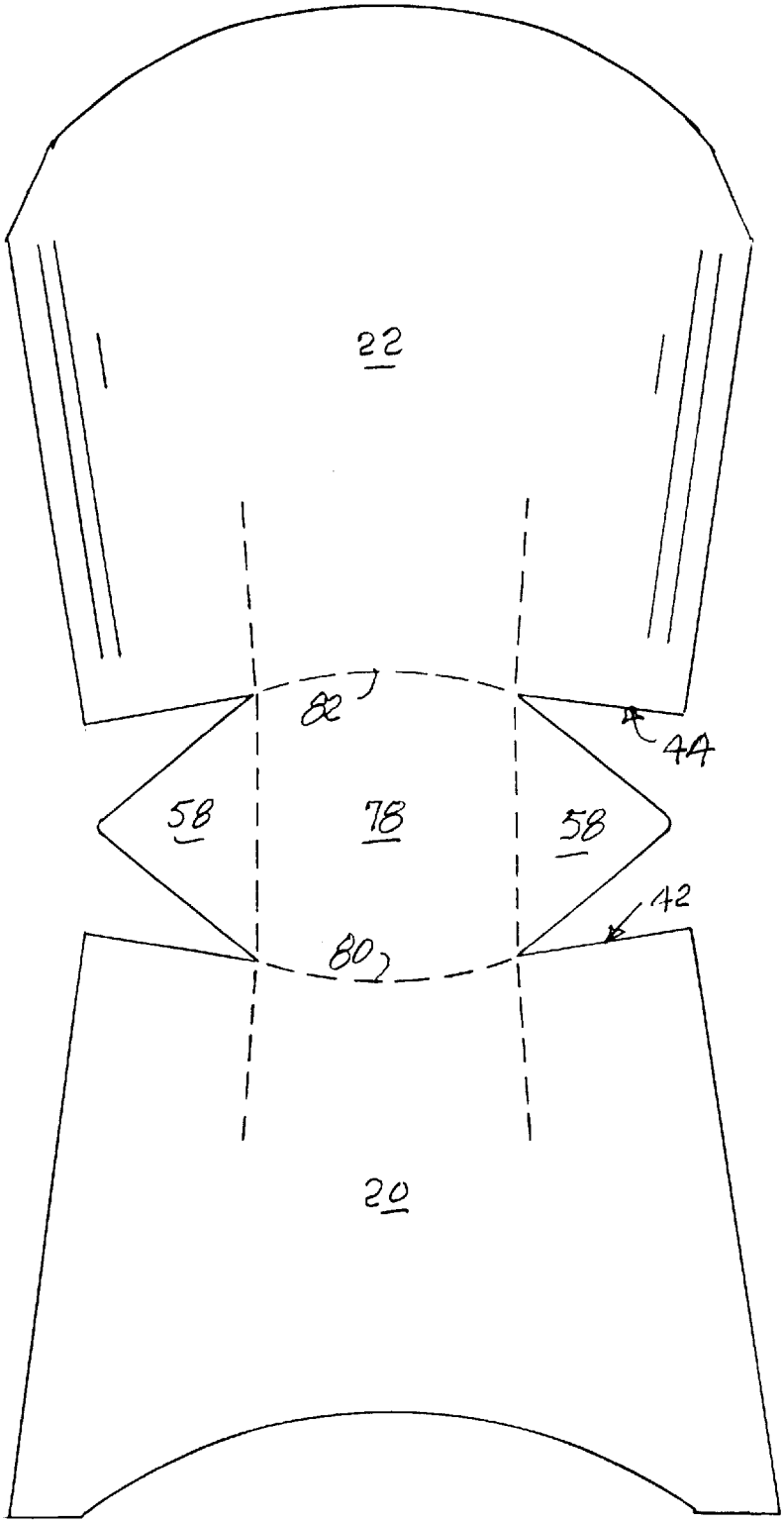
FIG. 8 is a plan view of the blank from which the scoop of FIGS. 5–7 is formed.

Noting the formed carton of FIGS. 5–7, it will be seen that the arcuate end edges 80 and 82 of the bottom panel 78 produce a side to side upward arching of the bottom panel 78 between the front and rear of the formed carton. Formed in this manner, the actual support of the carton, that is the support base thereof, is provided by a pair of full length laterally spaced bottom edges 86 defined at the opposed side edges of the bottom panel 78 and at the fold lines between the bottom panel 78 and the corresponding upwardly extending triangular sealing panels 58. Such an arched configuration of the bottom panel 78 strengthens the carton and provides for an actual increase in the internal volume of the carton through a slight outward bulging of the forward and rear sections of the front and rear wall panels while retaining the substantially rectangular lower portion of the carton. This is achieved without increasing the amount of material used in the construction of the carton or modification of the actual forming steps involved. In addition, by providing for the support of the carton along only a pair of opposed linear side edges 86, the stability of the carton in a self-supporting situation is enhanced. In other words, any surface irregularities in the support surface, whether a tabletop, the ground, or the like, can be readily accommodated by the spaced support edges, which might be considered as elongate support feet, as compared to the completely planar support surface formed by the previously described bottom panel 40.

As with the previously described embodiment, the formed carton of FIGS. 5–8 is sealed about the peripheral edges of the bottom panel 78 with the bottom or base edges of the front and rear panels intimately either integral with or seated in direct engagement with the edges of the bottom panel.

From the foregoing, it will be appreciated that a unique fry scoop has been defined which, both structurally and functionally, constitutes a significant advance in the art. As variations, within the scope of the claims appearing hereinafter, may occur to those skilled in the art, it is not intended to limit the invention to the specific embodiments illustrated.

What is claimed is:

1. A food scoop comprising a vertically elongate peripheral wall defining an upwardly opening container, said wall having an upper peripheral edge, and a lower peripheral edge with a bottom panel joined thereto, said upper edge having a first extent of a downwardly concave configuration and a second opposed extent of an upwardly convex configuration positioned higher relative to said first extent, said wall being of a substantially rectangular cross-section adjacent said lower edge and along a predetermined lower height of said scoop upward from said bottom panel, and of a substantially circular cross-section upward from said lower predetermined height along an upper predetermined height to said upper edge, said scoop being of a progressively increasing cross-section upward from said lower edge to said upper edge, said bottom panel having a first pair of laterally spaced coextensive edges integral with said wall along opposed lengths of said lower peripheral edge of said wall, and a second pair of spaced parallel linear edges extending between said first pair of edges and defining therewith a generally rectangular configuration for said bottom panel, said lower edge of said wall between said lengths thereof integral with said first pair of bottom edges being coextensive with said second pair of bottom panel edges and in engagement therewith along the full length of the second pair of edges, and a pair of side sealing panels, each having a base edge integral and coextensive with a linear edge of said second pair of parallel edges of said bottom panel, said side sealing panels overlying and being bonded to said peripheral wall of said scoop for a fixed height upward from said bottom panel.

2. The scoop of claim 1 wherein said peripheral wall includes a front wall panel with opposed vertical edges and a concave upper edge extending substantially between said vertical edges of said front wall panel and defining said first concave extent, and a rear wall panel with opposed vertical edges and an upper convex edge extending substantially between said vertical edges of said rear wall panel and defining said second convex extent, said opposed edges of said rear wall panel being bonded to said opposed edges of said front wall panel.

3. The scoop of claim 2 wherein said side sealing panels are triangular, each with side edges upwardly converging from opposed ends of the corresponding base edge.

4. The scoop of claim 3 wherein said bottom panel is planar and devoid of surface interruptions.

5. The scoop of claim 4 wherein said bottom panel is square.

6. The scoop of claim 5 wherein the side edges of said sealing panels are of equal length and terminate at an upper apex aligned with the bonded opposed edges of said front and rear wall panels.

7. The scoop of claim 2 wherein said bottom panel is planar and devoid of surface interruptions.

8. The scoop of claim 2 wherein said first pair of laterally spaced coextensive edges of said bottom panel are linear.

9. The scoop of claim 8 wherein said bottom panel is planar and devoid of surface interruptions.

10. The scoop of claim 2 wherein said first pair of laterally spaced coextensive edges of said bottom panel are arced and upwardly directed into the respective front and rear wall panels.

11. The scoop of claim 10 wherein said bottom panel is upwardly arched for the full length thereof between said arcuate first pair of bottom edges, said arched bottom panel extending transversely between said second pair of spaced parallel linear edges of said bottom panel whereby said second pair of bottom edges define laterally spaced support edges for said scoop.

12. The scoop of claim 11 wherein said bottom panel is devoid of surface interruptions.

13. For use in the formation of a food scoop of an inverted, truncated generally conical configuration; a unitary blank, said blank comprising opposed front and rear wall panels aligned along a longitudinal axis of said blank, said panels having spaced base edges, a bottom panel extending between said base edges of said front-and rear wall panels, said bottom panel having a first pair of opposed longitudinally spaced substantially coextensive end edges and a second pair of laterally spaced substantially parallel side edges, said bottom panel being integral with said base edges of said wall panels along said first opposed pair of end edges, a fold line coextensive with each bottom panel end edge for folding of said bottom panel relative to said wall panel lower edges, a pair of side sealing panels, each side panel having a first base edge integral and substantially coextensive with a side edge of said bottom panel, each side panel having an outer edge including edge lengths converging outward from opposed ends of the corresponding side edge of the bottom panel to an apex portion longitudinally spaced between said base edges of said front and rear wall panels.

14. The blank of claim 13 wherein each wall panel base edge includes a linear extent laterally to each side of said bottom panel, each linear extent being greater than one-half the longitudinal distance between the base edges of said front and rear wall panels as defined by the second pair of substantially parallel side edges of said bottom panel.

15. The blank of claim 14 wherein each of said front and rear wall panels includes lateral side edges diverging longitudinally outward from outer edges of the corresponding base edges.

16. The blank of claim 15 wherein said side edges of said front and rear panels extend at substantially right angles from the corresponding base edge extents.

17. The blank of claim 15 wherein said front wall panel has an outer edge concave for a major portion of the length thereof and with a linear lateral extension at each end of the concave portion extending to the corresponding side edges of the front wall panel, said rear wall panel having an outer edge convex for a major portion of the length thereof with beveled end edge portions extending to the corresponding side edges of the rear wall panel.

18. The blank of claim 14 wherein said first pair of opposed longitudinal end edges of said bottom panel are linear and parallel to each other, and wherein said second pair of bottom panel side edges are linear.

19. The blank of claim 14 wherein said first pair of end edges of said bottom panel are convex, and said second pair of bottom panel side edges are linear.

20. The blank of claim 19 wherein said bottom panel is planar and devoid of surface projections.

* * * * *